US006071075A

United States Patent [19]

Tomita et al.

[11] Patent Number: 6,071,075

[45] Date of Patent: Jun. 6, 2000

[54] COOLING STRUCTURE TO COOL PLATFORM FOR DRIVE BLADES OF GAS TURBINE

[75] Inventors: Yasuoki Tomita; Eiji Akita; Masao Terazaki, all of Hyogo-ken, Japan

[73] Assignee: Mitsubishi Heavy Industries, Ltd., Tokyo, Japan

[21] Appl. No.: 09/028,886

[22] Filed: Feb. 24, 1998

[30] Foreign Application Priority Data

Feb. 25, 1997 [JP] Japan ..... 9-040725

[51] Int. Cl.[7] ..... F01D 5/18

[52] U.S. Cl. ..... 416/97 R; 416/97 A

[58] Field of Search ..... 415/115, 116; 416/95, 96 R, 96 A, 97 R, 97 A

[56] References Cited

U.S. PATENT DOCUMENTS

| | | | |
|---|---|---|---|
| 3,066,910 | 12/1962 | Bluck | 416/96 R |
| 4,017,213 | 4/1977 | Przirembel | 416/97 A |
| 4,672,727 | 6/1987 | Field | 416/97 R |
| 4,946,346 | 8/1990 | Ito | 415/115 |
| 5,344,283 | 9/1994 | Magowan et al. | 415/115 |
| 5,382,135 | 1/1995 | Green | 416/97 R |
| 5,609,466 | 3/1997 | North et al. | 415/115 |
| 5,639,216 | 6/1997 | McLaurin et al. | 416/95 |
| 5,848,876 | 12/1998 | Tomita | 416/96 R |

FOREIGN PATENT DOCUMENTS

| | | | |
|---|---|---|---|
| 59-160003 | 9/1984 | Japan | 415/115 |
| 4-124405 | 4/1992 | Japan | 416/96 |
| 7-332004 | 12/1995 | Japan . | |
| 8-246802 | 9/1996 | Japan . | |

*Primary Examiner*—Christopher Verdier
*Attorney, Agent, or Firm*—Evenson, McKeown, Edwards & Lenahan, P.L.L.C.

[57] ABSTRACT

A mechanism for cooling the platform for the drive blades of a gas turbine uses a simple configuration which reliably cools the platform. The mechanism includes cooling channels in the interior of the platform which open out from one of the cooling air channels for cooling the turbine blades and which exit the platform through the edge nearest the tail. Cooling channels in the platform open out from the entrance to blade cooling channels, travel from the head of the blade along the blade sides, and exit through the edge near the tail of the blade. This structure diverts a portion of the cooling air entering the blade from the cooling channel in the base in order to cool the platform. Cooling air channels may extend from an enclosed air space below the platform to the upper surface of the platform at the front or rear side of the blade. Air channels may also extend on the rear of the turbine blade obliquely from the underside of the platform to the trailing edge of the platform. These channels or combinations thereof constitute a cooling structure through which air can flow to cool a platform for the drive blades of a gas turbine in an efficient and effective manner.

5 Claims, 4 Drawing Sheets

COOLING STRUCTURE TO COOL PLATFORM FOR DRIVE BLADES OF GAS TURBINE

FIELD OF THE INVENTION

This invention concerns a cooling structure which cools the platform for the drive blades of a gas turbine.

BACKGROUND OF THE INVENTION

Heretofore, various types of cooling structures for gas turbine drive blades have been made public. In FIG. 4 is shown a typical prior art design for a cooling structure for the air-driven blades in a gas turbine. With such a cooling structure, the air which enters via channels 4*a* and 4*b* on blade base 1 flows into blade cooling channels 5*a* and 5*b* within blade 3 in the direction indicated by the arrows; in this way it cools blade 3.

The air which flows from channel 4*a* on blade base 1 into blade cooling channel 5*a* on the leading edge 3*a* of blade 3 traverses a number of fins 13 (turbulators). As it flows through blade cooling channel 5*a*, which winds back and forth to follow the shape of drive blade 3, the air cools drive blade 3. It then flows out via hole A on the thin tip 14 of the blade and is mixed in with the main gas flow.

The air which flows from channel 4*b* on blade base 1 into channel 5*b* on the rear half of the edge of blade 3 must pass back and forth around a number of fins 13 which are provided in channel 5*b*. The air cools the trailing edge 3*b* of the blade via pin fins 15, then flows out through holes or slits B to mix with the main gas flow. A number of drive blades with this sort of high-speed cooling configuration are placed adjacent to each other along the circumference of platform 16 and set into disk 17.

Devices of the prior art such as those described above have hollow drive blades with a configuration in the base of the blade or its interior to provide high-speed cooling. However, since the platform from which the cooling components protrude is not itself cooled, the cooling capacity is insufficient.

Although the drive blade platform of a high-temperature gas turbine must be cooled, cooling it effectively induces thermal stress which must then be mitigated. Temperature differentials in excess of 1,000° C. may occur between the air in the gas seal on the side of the platform with the gas channels and the air in the seal on the underside where the rotor is.

To address this problem, a number of configurations have been suggested which can effectively cool the platform surface and at the same time mitigate the temperature differential between the upper and lower surfaces of the platform.

One of these configurations, suggested by the present inventors, is published in Japanese Patent Publication 7-332004 of the Japanese Patent Office. In this configuration, holes are provided at the ends of the enclosed air channels which radiate from the center of the platform. Vents formed from shaped film are also provided on the upper surface of the same air channels. With this design the enclosed air which flows over the bottom of the platform passes through the holes at the ends of the radii, enters the shaped film vents and spreads out over the top of the platform to cool it effectively. If slits are provided which extend from the holes in the air channels to the edge of the platform, the expansion and contraction of these slits will mitigate the thermal stress occasioned by the temperature differential between the top and bottom of the platform. The slits will also prevent the platform from expanding.

Another such configuration was suggested by the present inventors in Japanese Patent Publication 8-246802. In this configuration, air channels are provided into which air is supplied from the base of the blade of a gas turbine on either its underside or its topside. This air passes through the interior of the platform in the vicinity of the bottom of the blade and then flows on either side of the blade. It is released at the end of either the top or bottom of the blade. In this way the platform is cooled.

Each of these configurations has its good and bad points. Currently there is a demand that a turbine operate at an even higher temperature in order to boost its efficiency. It would also be advantageous if the configuration used to cool the turbine could be formed using simpler techniques. Thus there is a demand for an efficient cooling configuration which requires fewer production processes.

SUMMARY OF THE INVENTION OBJECTIVES

The present invention is designed to address the technical issues discussed above. The object of this invention is to provide a cooling structure and method to cool the platform for the drive blades of a gas turbine using a simple configuration and technique. This structure primarily comprises air channels in the interior of the platform which open into one of the cooling channels in the blades with exits at the tail ends of the blades.

This invention, which will resolve the issues discussed, is a design for a configuration to cool the platform for the drive blades of a gas turbine. Two cooling channels are created in the interior of the platform extending from the leading edge of the blade, splitting back to both front and rear sides all the way to its trailing edge. One end of each of these cooling channels opens into the blade cooling channel nearest the leading edge of the blade. The other end of each cooling channel opens into the exterior via the edge of the platform nearest the trailing edge of the blade.

According to this invention, a portion of the cooling air for a drive blade flowing from the base of the drive blade of a gas turbine into the blade cooling channel at the leading edge of the blade is made to flow into two platform cooling channels which cool the platform and are connected to the blade cooling channel at the leading edge of the blade. This air cools the interior of the platform around the leading edge of the blade and then the interior of the portion of the platform in the front side and the rear side of the blade. It exits via the edge of the platform nearest the trailing edge of the blade.

This invention provides a configuration such that each of the two platform cooling channels connects with one of the aforesaid blade cooling channels which is provided closest to the leading edge of the blade. Because the two platform cooling channels inside the platform connect with the blade cooling channel closest to the leading edge of the blade, i.e., near the head of the blade, the air which is supplied into the two aforesaid platform cooling channels is relatively cool, since it has not yet cooled the interior of the blade. This design enhances the cooling effect experienced by the platform.

Further, the present invention proposes a configuration to cool the platform for the drive blades of a gas turbine which has at least one of the following features: a number of channels through which enclosed air from the spaces under the platform between the bases of the blades can flow, which extend through the interior of the platform in a relative radial direction on the front side of the blade and exit on the front surface of the platform; a number of channels for convection cooling which extend through the interior of the platform in a relative radial direction from the leading edge of the blade on the front and rear sides of the blade and exit from the surface of the platform at the front and rear sides of the blade; and air channels which pass through the trailing edge of the platform behind the blade and exit through the edge behind the tail of the blade.

With this invention, enclosed air channels which traverse the lower surface of the platform, holes which direct the enclosed air onto the upper surface of the platform or the edge of the platform at the tail of the blade, and holes for convection cooling are provided in at least one of the following orientations: toward the front of the blade or extending from its head (the front edge of the platform) to its back and front; or toward the tail of the blade (the rear edge of the platform). The enclosed air which flows over the undersurface of the platform enters the appropriate enclosed air holes and convection cooling holes. One of these sets of holes, funnels the air out onto the platform in front of the blade. In this way the part of the platform in front of the blade is cooled effectively from either the interior or the surface. Another set of holes beginning at the head of the blade effectively cools the front edge of the platform and the portions in front of and behind the blade. A third set of holes channels air from inside the platform so that it can effectively cool the rear edge of the platform at the tail of the blade.

Furthermore, this invention, namely a configuration to cool the platform for the drive blade of a gas turbine, entails the creation of two channels inside the platform, which run from the head of the blade down either side to its tail. One end of each of these cooling channels opens from a cooling channel inside the head of the blade which cools the blade. The other end exits the platform through the edge near the tail of the blade. This configuration has at least one of the following features: a number of holes through which the enclosed air can flow, which go through the interior of the platform in a more or less radial direction in front of the blade and exit on the surface of the platform in front of the blade; a number of holes for convection cooling which go through the interior of the platform in a more or less radial direction from the head of the blade to its front and back sides and exit from the surface of the platform behind the blade and in front of it; and/or air channels which begin at the rear edge of the platform behind the blade and exit via the edge behind the tail of the blade.

With this invention, specific portions of the platform can be cooled by combining two configurations. In the first configuration, the air meant for the channels in the blade is supplied to a bypass and made to flow through cooling channels in the platform on both sides of the blade in order to cool the platform. In the second configuration, enclosed air is supplied either to channels which run in front of the blade, from the head of the blade to its front and back, or from the rear edge of the platform behind the blade to near its tail.

DETAILED DESCRIPTION OF THE PREFERRED EMBODIMENTS

In this section we shall give a detailed explanation of several preferred embodiments of this invention with reference to the drawings. To the extent that the dimensions, material, shape and relative positions of the constituent components are not specifically disclosed in these embodiments, the scope of the present invention is not limited by these factors. The embodiments serve merely as illustrative examples.

Figure 1:
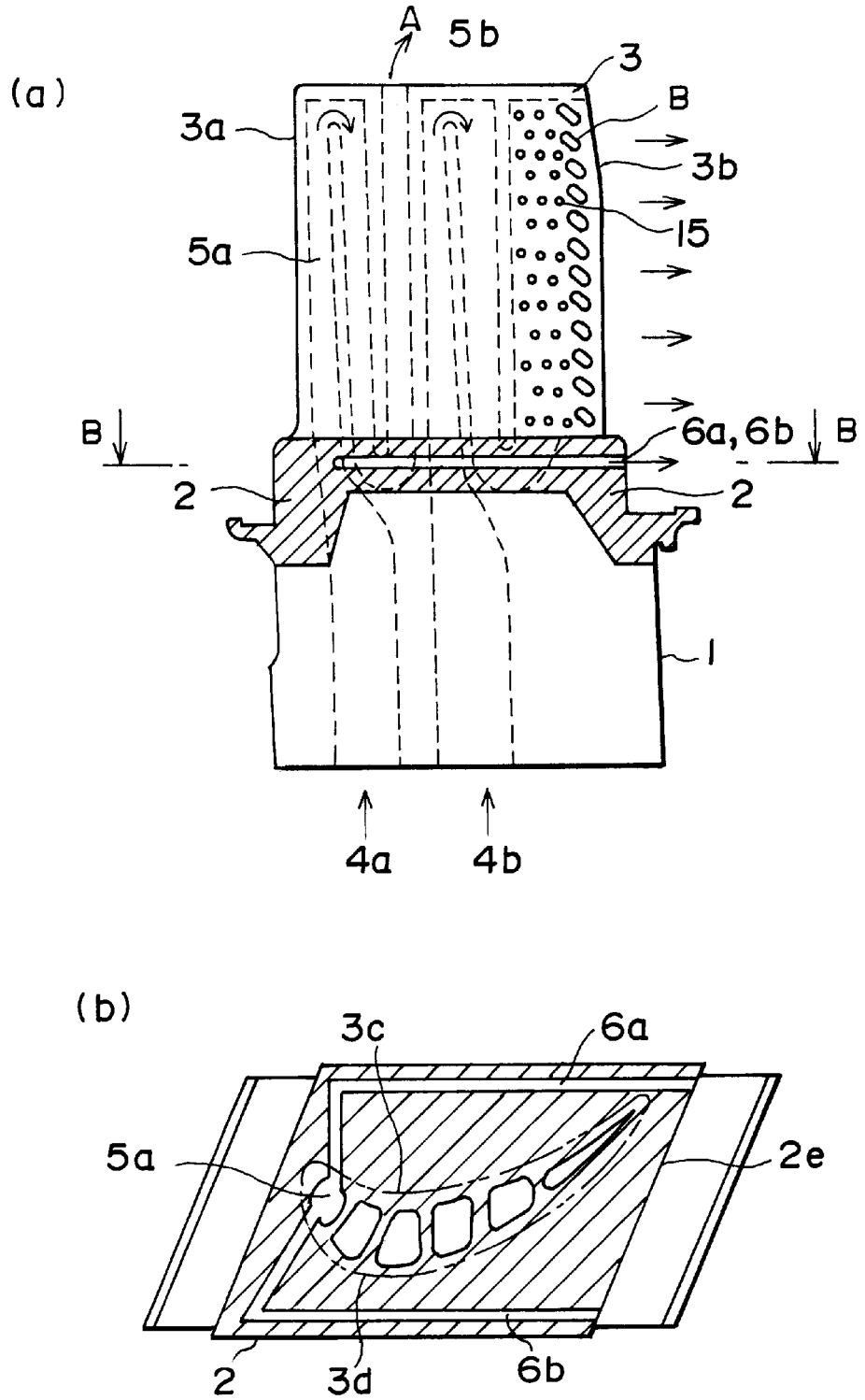
FIG. 1 shows a drive blade of a gas turbine which is a first preferred embodiment of the present invention. (a) is a lateral cross section. (b) is a horizontal section taken along line B—B in (a).

We shall explain the first embodiment of this invention with the help of FIG. 1. FIG. 1(*a*) shows a lateral cross section of the drive blade of a gas turbine. FIG. 1(*b*) is a horizontal cross section taken along line B—B in (a).

1 is the base of the blade; 2 is the platform; 3 is the blade. In order to cool blade 3, just as in the prior art design discussed above, air is introduced from the bottom of base 1 in the direction shown by the arrows 4*a* and 4*b*. This air is supplied from cooling channels in the base into blade cooling channels 5*a* and 5*b* in blade 3, respectively.

Just as in prior designs, blade cooling channels 5*a* and 5*b* wind back and forth inside blade 3 and contain numerous fins (turbulators), which have been omitted from the drawing.

The air which flows from channel 4*a* in base 1 into blade cooling channel 5*a* on the leading edge 3*a* of blade 3 cools the blade as it negotiates the channel, which meanders back and forth following the contour of blade 3. The airflow exits via hole A in the top of the blade and joins the main gas flow.

The air which flows from channel 4*b* in base 1 into blade cooling channel 5*b* in the trailing edge 3*a* of the blade winds back and forth through the channel and cools the trailing edge by means of pin fins 15. This air exits via hole or slit B and joins the main gas flow.

These aspects of the configuration are common to the prior art design discussed earlier.

As can be seen in FIG. 1(*b*), with this invention cooling channels 6*a* and 6*b* in platform 2 extend alongside the front side (3*c*) and the rear side (3*d*) of blade 3 to the trailing edge 2*e* of the platform. Near the leading edge of the platform, these channels angle toward the leading edge of the blade, which is located in the center of the platform. They run into the entrance to blade cooling channel 5*a*, which is close to the leading edge of the platform. The platform cooling channels 6*a* and 6*b* are used to split a portion of the air flow from channel 4*a* so that instead of going into blade 3, it flows into platform 2.

Platform cooling channels 6*a* and 6*b*, in other words, connect with the inlet of the aforesaid channel 5*a*, which cools the blade, in the aforesaid platform 2. From the leading edge of the blade, these channels traverse the interior of platform 2 on both the front and rear sides of the blade (i.e., on sides 3*c* and 3*d*) and exit via edge 2*e*, the trailing edge of the platform. This configuration causes a portion of the airflow from channel 4*a* in base 1, most of which goes into the drive blade, to be diverted into platform 2.

In an embodiment configured in this way, the air 4*a* which is supplied to blade cooling channel 5*a* strikes the walls of the channel as it flows because of the turbulence produced by the aforesaid turbulators as it negotiates the winding channel; in this way blade 3 is cooled. From the top of the blade, the air exits to join the main gas flow. A portion of this air 4*a* branches off from blade cooling channel 5*a* in the interior of platform 2 and passes through platform cooling channels 6*a* and 6*b* to cool the inside of the platform on sides 3*c* and 3*d* of the blade. This air exits the platform via edge 2*e*.

Thus in this embodiment a portion of cooling air 4*a* is split to cool designated areas of platform 2. We have been discussing a design by which platform cooling channels 6*a* and 6*b* open into channel 5*a* on the leading edge of blade 3 and 5*a* winds back and forth inside blade 3. Thus platform 2 is cooled effectively by low-temperature air which has not yet cooled the interior of blade 3. It would, of course, be equally acceptable to have cooling channels 6*a* and 6*b* flow into a secondary location in channel 5*a* instead of the portion near the leading edge of the platform, if the required level of cooling could be achieved in this way.

Figure 2:
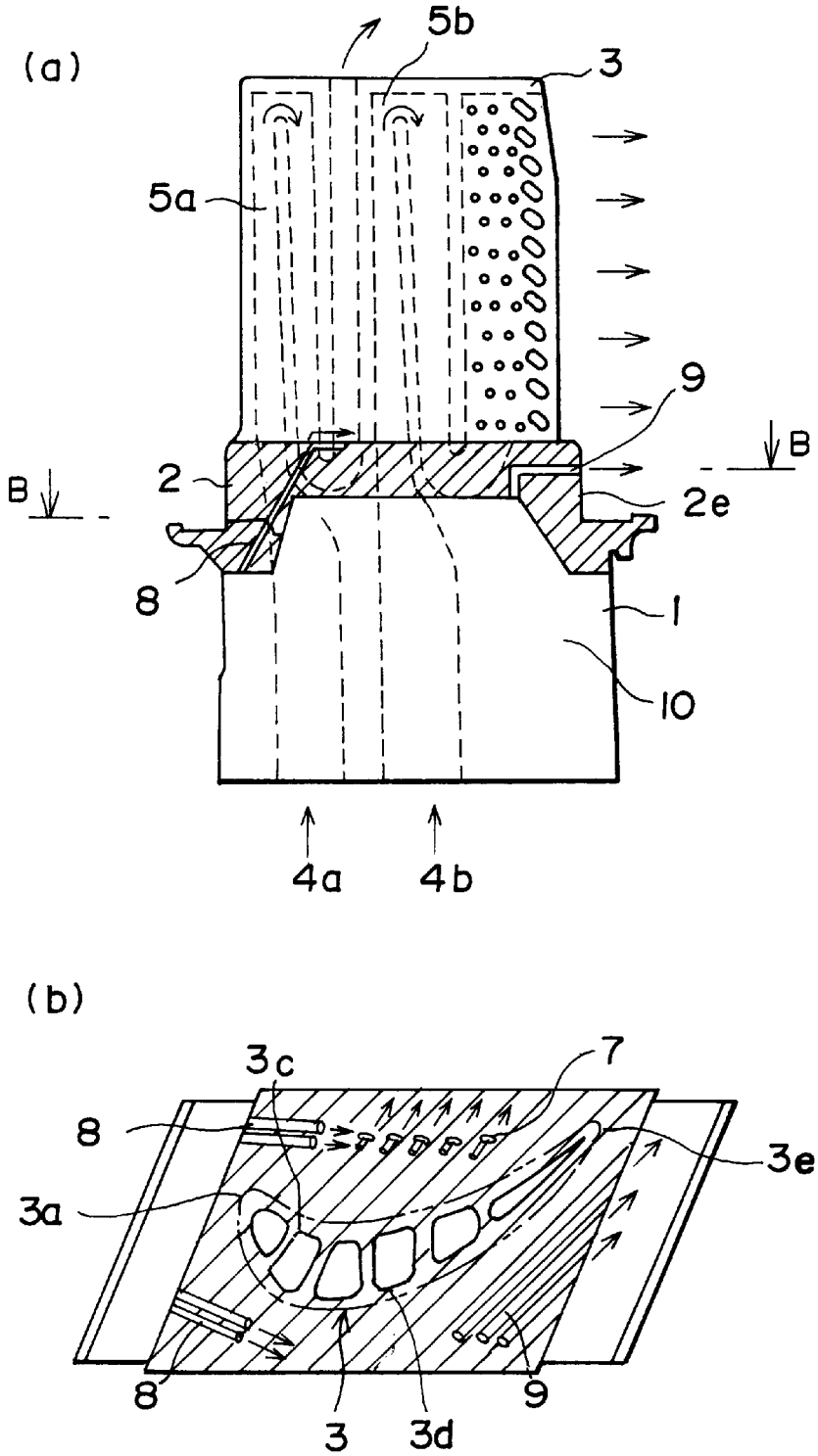
FIG. 2 shows a drive blade of a gas turbine which is a second preferred embodiment of the present invention. (a) is a lateral cross section. (b) is a horizontal section taken along line B—B in (a).

We shall next discuss the second preferred embodiment of this invention with reference to FIG. 2. FIG. 2(*a*) is a lateral cross section of the drive blade of a gas turbine. FIG. 2(*b*) is a horizontal cross section taken at line B—B in (a). Components which have the same function as those in the first embodiment discussed above have been labeled with the same numbers, and explanation which would be redundant has been omitted.

Figure 4:
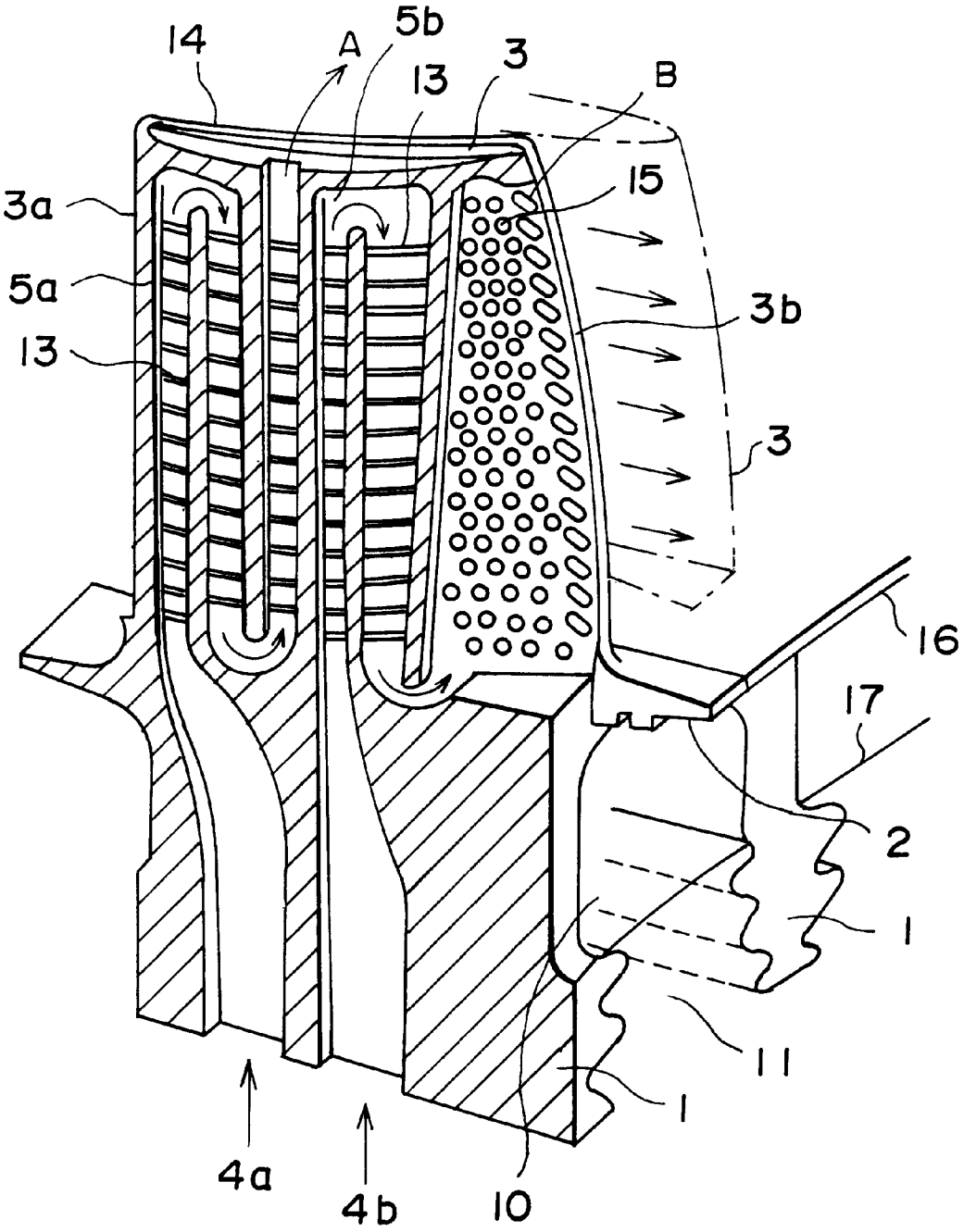
FIG. 4 PRIOR ART
FIG. 4 is a lateral cross section of the blade of a gas turbine which is an example of the prior art.

In this embodiment, the undersurface of platform 2 for the drive blade of a gas turbine is cooled by having seal air 10 flow over it. As can be seen in FIG. 4, this seal air 10 is contained in space 11, which is under platform 2 between bases 1 of blades 3. As is shown in FIG. 2(*b*), a number (here there are five, but more or fewer could be provided) of platform cooling air channels 7 for seal air are cut in the interior of platform 2 on the front side 3*c* of the blade. These channels are oriented in a radial direction relative to the shaft of the turbine. Cooling air channels 7 go from seal air space 10 in base 1 below platform 2 to the upper surface of platform 2 on front side 3*c* of the blade, where they exit. The outlets of the channels are not pictured in detail, but the air is effectively distributed over the surface of the platform by blowholes which spread it in a fan-shape.

With cooling air channels 7 of this sort, the air 10 which flows through seal air space 10 below platform 2 goes through holes 7 in a radial direction with respect to the shaft of the turbine and flows onto the upper surface of platform 2. The blowholes spread the air over the surface of platform 2 as it flows in the direction shown by the arrows. This effectively cools the upper surface of platform 2. The blowholes may be oriented so that the air flows toward the adjacent blade, as shown by the arrows; or they may be oriented in whatever direction is judged appropriate, such as toward the front side of the blade.

A number of convection cooling channels 8 for convection cooling are provided on the leading edge of platform 2, the edge nearest the head of the blade. (Here there are two channels on side 3*c* and two on side 3*d* of the blade, all of which go toward the middle of the platform; but more or fewer channels could be provided as needed.) Convection cooling channels 8 travel through platform 2 in a radial direction with respect to the shaft of the turbine. They are angled toward the upper surface of the platform on sides 3*c* and 3*d* of the blade.

Just as with cooling air channels 7 discussed above, blowholes (not pictured) can be provided on the outlets of convection cooling channels 8 on sides 3*c* and 3*d* of the upper surface of the platform. This will enhance the effectiveness of the cooling.

Providing this sort of convection cooling channels 8 allows the seal air 10 which flows in space 11 below platform 2 to go through convection cooling channels 8 in a radial direction with respect to the shaft of the turbine. This air travels upward on an angle and exits on the upper surface of platform 2 on sides 3*c* and 3*d* of the blade. The shaped film blowholes spread the air out over the surface of platform 2 as it flows in the direction shown by the arrows, and it effectively cools the surface of platform 2.

A number of air channels 9 are cut through the rear side of platform 2 near the trailing edge 3*e* of drive blade 3. (Here three channels are shown, but more or fewer could be provided as needed.) Through these channels, the air 10 from seal air space 11 below platform 2 traverses the interior of the platform on side 3*d*. The channels exit the platform via its trailing edge 2*e*.

These air channels 9 allow the seal air 10 which flows over the lower surface of platform 2 to travel at first in a radial direction with respect to the shaft of the turbine and then in an oblique direction. They exit from the interior of platform 2 via its trailing edge 2*e*, thus cooling the edge from inside.

In this embodiment we have been discussing a design which entails three different types of cooling channels: cooling air channels 7, convection cooling channels 8 and air channels 9. However, it is not essential that all three types of holes be provided. One type may be used, or two of the three or all three may be combined as is deemed appropriate.

Figure 3:
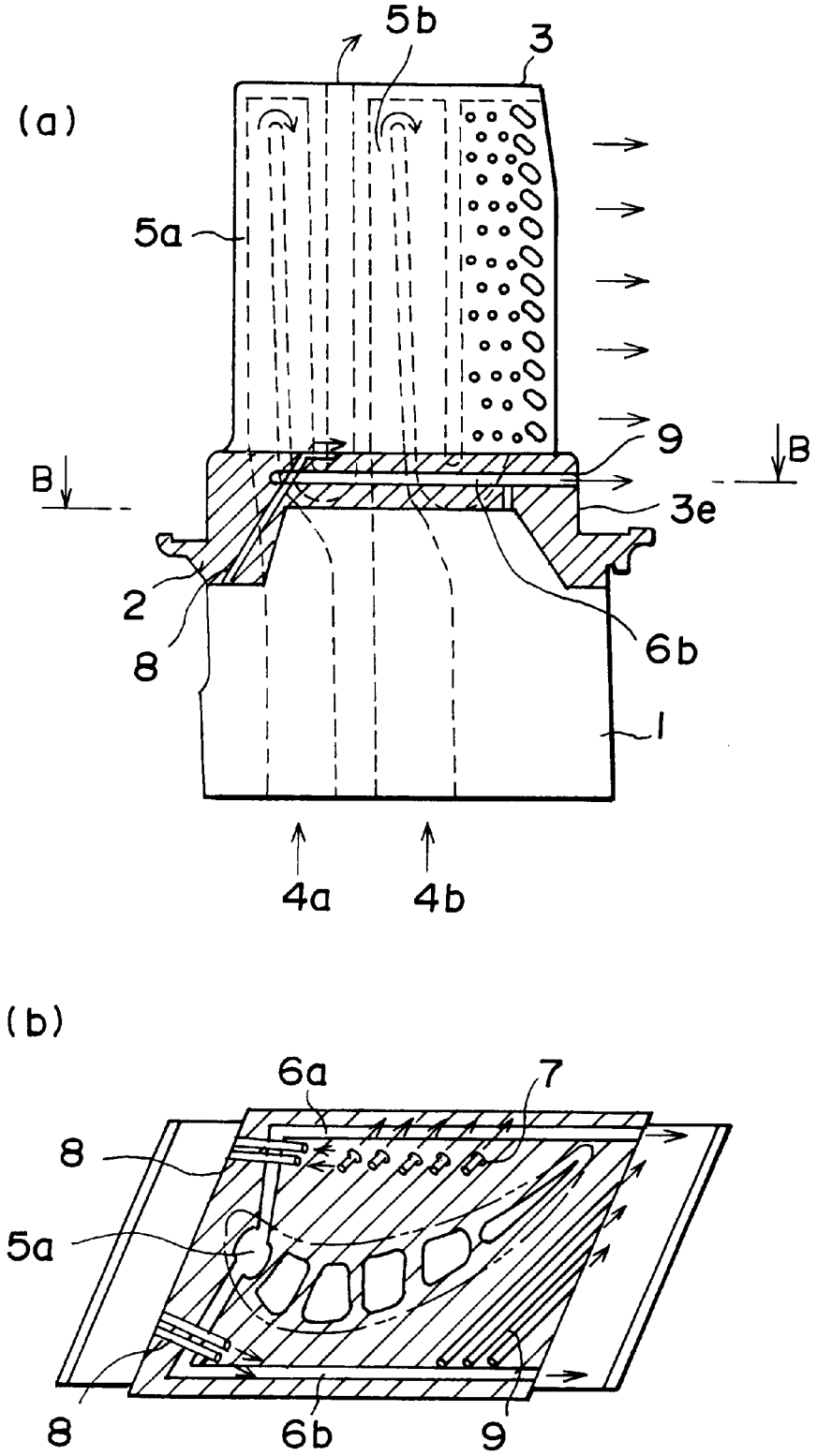
FIG. 3 shows a drive blade of a gas turbine which is a third preferred embodiment of the present invention. (a) is a lateral cross section. (b) is a horizontal slice taken along line B—B in (a).

We shall next discuss the third preferred embodiment of this invention with reference to FIG. 3. FIG. 3(*a*) is a lateral cross section of the drive blade of a gas turbine. FIG. 3(*b*) is a horizontal cross section taken at line B—B in (a).

As can be understood from FIG. 3, this embodiment combines the features of the first embodiment, pictured in FIG. 1, and the second embodiment, pictured in FIG. 2. It incorporates both configurations and achieves the combined functions and operational effects of both the previous embodiments.

In other words, this embodiment has two cooling channels 6*a* and 6*b* and several cooling air channels 7, convection cooling channels 8 and air channels 9. Cooling channels 6*a* and 6*b* in the aforesaid platform 2 open from the entrance to the aforesaid channel 5*a*, which cools the blade. From the leading edge of the blade, they travel along its sides 3*c* and 3*d* and exit via the edge 3*e* near its trailing edge. Cooling air channels 7 extend from the enclosed space 11 between blade bases 1 below platform 2 to the upper surface of the platform on side 3*c*, where they exit.

Aspects of the embodiment which are identical to corresponding aspects of the first and second embodiments discussed above have been labeled with the same numbers, and explanation which would be redundant has been omitted.

Up until now we have been discussing the embodiments which are pictured; however, the present invention is not limited to these embodiments only. As long as they remain within the scope of this invention, various modifications may be made in the configurations here described.

In this embodiment, two cooling channels 6*a* and 6*b* are cut through the interior of platform 2 extending from the leading edge of the blade 3*a* to the side of the platform near the trailing edge of the blade 3*e* along both sides of the blade, 3*c* and 3*d*. One end of each of these channels, 6*a* and 6*b*, opens out from channel 5*a*, which cools the blade, near the leading edge of the blade. The other end exits the platform via edge 2*e* near the trailing edge of the blade. These channels constitute a mechanism to cool the platform for the drive blade of a gas turbine. The cooling air 4*a* is split into channels 6*a* and 6*b*, which open out from blade cooling channel 5*a*. As the cool air traverses cooling channels 6*a* and 6*b* to where they discharge from edge 2*e* of platform 2 near the trailing edge of the blade, it insures that the platform will not experience any thermal effects. This design effectively cools the platform.

With this invention, one end of each of the aforesaid cooling channels 6*a* and 6*b* opens out from channel 5*a*, which cools the leading edge of the blade. These channels constitute a mechanism to cool the platform for the drive blade of a gas turbine. The air which flows into channels 6*a* and 6*b* behind and in leading edge of the blade bypasses the cooling channel in the leading edge of the blade. Since it has not yet been used to cool the blade, the air which passes through the aforesaid channels 6*a* and 6*b* has a relatively low temperature when it is used to cool platform 2. This design enhances the cooling effect on platform 2.

This invention constitutes a mechanism to cool the platform for the drive blade of a gas turbine which entails at least one of three different types of cooling holes: cooling air channels 7, which go from the space 11 between blade bases 1 below platform 2 to the upper surface of the platform, where they exit; convection cooling channels 8; and air channels 9. Supplying seal air via these channels is an effective way to cool a platform and its surface, especially one liable to be subjected to heat, easily and efficiently.

Also, this invention combines two cooling effects, that achieved by diverting some of the air from the blade channel into channels 6 in front of the blade and behind it, and that achieved by forcing the seal air through at least one of three types of holes: the aforesaid cooling air channels, the aforesaid convection cooling channels and the aforesaid air channels. This design suppresses high-temperature oxidation of the platform and minimizes the temperature differential between the upper side of the platform, where the gas channels are, and the lower side of the platform, where the rotor is. The design has the effect of making the temperatures on the two sides more nearly uniform. This mitigates thermal stress and so increases the service life of the drive blade of the gas turbine.

Various other effects are also achieved.

We claim:

1. A cooling structure for cooling a platform for drive blades of a gas turbine, comprising:

a first cooling channel in an interior of the platform extending from a leading edge of a drive blade alongside a front side of said drive blade to a rear part of the platform adjacent a trailing edge of said drive blade, said first cooling channel having an inlet which is connected to a blade cooling channel disposed adjacent the leading edge of said drive blade and an outlet adjacent said trailing edge of said drive blade; and a second cooling channel in the interior of the platform extending from the leading edge of said drive blade alongside a rear side of said drive blade to said rear part of the platform adjacent said trailing edge of said drive blade, said second cooling channel having an inlet which is connected to said blade cooling channel disposed adjacent said leading edge of said drive blade and an outlet adjacent said trailing edge of said drive blade.

2. A cooling structure according to claim 1, wherein said first and second cooling channels each connect with said blade cooling channel upstream of said blade cooling channel, whereby a portion of cooling air from said blade cooling channel is diverted into each of said first and second cooling channels before the air enters the blade.

3. A cooling structure for cooling a platform for drive blades of a gas turbine, comprising:

a first cooling channel in an interior of the platform extending from a leading edge of a drive blade alongside a front side of said drive blade to a rear part of the platform adjacent a trailing edge of said drive blade, said first cooling channel having an inlet which is connected to a blade cooling channel disposed adjacent the leading edge of said drive blade and an outlet adjacent said trailing edge of said drive blade;

a second cooling channel in the interior of the platform extending from the leading edge of said drive blade alongside a rear side of said drive blade to said rear part of the platform adjacent said trailing edge of said drive blade, said second cooling channel having an inlet which is connected to said blade cooling channel disposed adjacent said leading edge of said drive blade and an outlet adjacent said trailing edge of said drive blade, and at least one platform cooling passage selected from the group consisting of:

(a) cooling air channels extending from an underside of the platform through the platform to an upper surface of the platform on the front side of the drive blade, whereby air from a seal air space under the platform can flow through the platform to cool the upper surface of the platform;

(b) convection cooling channels extending from a leading edge of the platform at an angle to an upper surface of the platform at the front or rear side of the drive blade, whereby air from a space underneath the platform can pass through the platform to cool the upper surface of the platform; and (c) air channels extending from the underside of the platform obliquely through the rear part of the platform on the rear side of the drive blade adjacent a trailing edge of the platform, whereby air from underneath the platform can flow through the platform to the platform trailing edge to cool said platform trailing edge.

4. A cooling structure according to claim 3, wherein said first and second cooling channels each connect with said blade cooling channel upstream of said blade cooling channel, whereby a portion of cooling air from said blade cooling channel is diverted into each of said first and second cooling channels before the air enters the blade.

5. A cooling structure according to claim 3, wherein said cooling air channels extend to the upper surface of the platform at the front side of the drive blade;

wherein at least one of said convection cooling channels extends from the leading edge of the platform to the upper surface of the platform at the front side of the drive blade and at least one other of said convection cooling channels extends from the leading edge of the platform to the upper surface of the platform at the rear side of the turbine blade, and wherein a plurality of said air channels on the rear side of the drive blade extend obliquely to the trailing edge of the platform.

* * * * *